US006447035B1

(12) United States Patent
Kohout

(10) Patent No.: US 6,447,035 B1
(45) Date of Patent: Sep. 10, 2002

(54) FLOATING RINGS SLING

(76) Inventor: Bernard J. Kohout, 110 Barnes St., Carrboro, NC (US) 27510

( * ) Notice: Subject to any disclaimer, the term of this patent is extended or adjusted under 35 U.S.C. 154(b) by 0 days.

(21) Appl. No.: 09/884,279

(22) Filed: Jun. 20, 2001

(51) Int. Cl.[7] ..... B66C 1/12
(52) U.S. Cl. ..... 294/74
(58) Field of Search ..... 294/74, 82.1, 82.11, 294/82–14; 73/760, 856, 158

(56) References Cited

U.S. PATENT DOCUMENTS

| | | | | | |
|---|---|---|---|---|---|
| 1,686,288 | A | * | 10/1928 | Meals | 24/129 A |
| 2,152,096 | A | * | 3/1939 | Russell | 294/74 |
| 2,569,912 | A | * | 10/1951 | Andersen | 294/74 |
| 3,583,750 | A | * | 6/1971 | Norton | 24/200 |
| 5,330,240 | A | * | 7/1994 | Barra | 294/74 |

FOREIGN PATENT DOCUMENTS

| | | | | | |
|---|---|---|---|---|---|
| CA | 626635 | * | 8/1961 | | 294/74 |
| FR | 2678918 | * | 1/1993 | | 294/74 |
| GB | 423391 | * | 1/1935 | | 294/74 |

* cited by examiner

*Primary Examiner*—Dean J. Kramer
(74) *Attorney, Agent, or Firm*—Seto Patents

(57) ABSTRACT

A circular sling with at least one floating ring used to lift and move objects, such as logs and poles. Preferably, two rings located at opposite ends of the circular sling are used to pull the circle taught and create a type of double strap sling. The present sling can be used in all well known lifting techniques that traditionally employ a single strap sling as well as additional techniques made possible by the present circular sling. Particular benefits are provided when the present sling is used in a new modified double basket lifting method. The sling can be made of a man made webbing and the rings are preferably made of a metal or metal alloy. Each ring has an associated stress ball that is a solid ball used in a simple stress test. When a ring is in good working condition the stress ball passes freely through the middle of the ring. When the sling has been over stressed the ring warps slightly inward and the stress ball can no longer pass through the middle of the ring.

10 Claims, 5 Drawing Sheets

FLOATING RINGS SLING

BACKGROUND OF THE INVENTION

The present invention relates generally to slings used for lifting large, heavy objects, and more specifically to a sling with a circular strap that passes through one or more rings. The ring(s) aid in attaching the sling to a crane and they float freely around the strap.

The type of sling described in this application is not of the type that David used to slay Goliath, i.e., not a weapon. Rather, the present invention relates to the type of sling that is used for cradling and hoisting objects. These types of slings typically include a rope, strap, chain or cable that can be looped around an object. Straps are commonly made of a webbing material that can be man-made or natural. Lengths of rope, straps, chains or cables (herein after "straps") each have the ability to loop back on itself. With minor adjustments or with the addition of a small amount of hardware straps can also make a slip noose. A slip noose is a useful feature because the noose tightens around the object by pulling on the end opposite of the loop. When the loop of a sling is placed around an object the sling can be used as a support, a cradle or to hoist the object.

Slings have traditionally been used to haul and lift heavy, awkward objects. Their pliable material can conform to the shape of the object to be lifted, making them versatile. Industries such as forestry, utility and logging commonly use slings to move trees, poles and logs.

Because the present sling uses a circular design the number of straps, or support legs, is doubled compared to traditional single strap slings. In other words, when a loop is formed at one end of the present sling and the opposite end is used to hoist the object, there are actually two straps that are supporting the object. In the preferred method of using the present sling, both ends of the slings are used for lifting or supporting and thus four straps, support legs, are actually involved.

The preferred method for using the present sling is a modified double basket. A double basket is a well known lifting technique traditionally involving a long single strap that is wrapped one and a half times around a log or pole and then both ends of the strap are used to lift the object. A double basket is beneficial in two ways. First, it provides slip noose like gripping capabilities with no modifications to traditional single strap slings. Second, since both ends of the strap are involved in lifting the log, as much as twice the amount of weight can be lifted compared to the single strap's lifting maximum. Each of these benefits however, is also accompanied by a failing when a traditional sling is employed. First, the slip noose like grip of the traditional double basket does not provide as tight of a grip as a traditional slip noose, per square inch. Second, each support leg is still only as strong as a single strap. The present modified double basket method eliminates both of these failings. The present sling, used in the preferred method, provides better gripping ability than a slip noose and each support leg provides twice the strength of a single strap. Thus, the well known double basket lifting method can still be used by those in the field but, with the present sling the lifting method will be more efficient, simply by employing a slight but important modification.

The rings that may float freely around the present sling also provide a novel feature. They are designed to provide a quick and easy stress test that indicates when the strap has lifted too much weight and therefore should be discarded. Each ring has an associated stress ball that is a solid ball designed to pass through the middle of its associated ring, when the ring is in good operating condition. The inside diameter of the floating ring is roughly equal to the diameter of its associated stress ball. In the event that the strap has been over stressed either by lifting too heavy of a load or because of stress over time, the ring will dis-form inward and the stress ball will no longer be able to pass through the middle of the ring. If a user tries to pass a stress ball through its associated ring and the stress ball cannot fit through the middle of the ring, then the ring and therefore the strap has failed the stress test and that floating rings sling should be discarded.

The present sling can be used in other methods besides the preferred modified double basket method. For example, the sling can be used in a single basket lifting method and in a traditional slip noose. In the slip noose method, one of the rings is looped through the circular strap or a second larger ring in order to create the noose. The circular strap and rings can be provided in a variety of sizes and the strap can have one or more floating rings. Thus, many more uses are made possible by the present sling and are not limited to the above examples.

SUMMARY OF THE INVENTION

The present invention provides a circular strap used for lifting objects wherein one or more metallic rings float freely around the circular strap and at least one of the rings is used as a connection point that is connected to a lifting force, such as a crane or winch. The circular strap can be used in well known lifting techniques that normally employ a single strap sling, as well as other techniques that are not possible with a single strap sling. In the preferred embodiment, the strap has a uniform width and is made of a man made webbing material. In alternative embodiments, the strap is made of other materials. The one or more rings are made of metal or a metal alloy and each ring has an associated stress ball that provides a quick and reliable stress test for the sling. Rings in good operating condition allow the stress ball to pass through their middle freely. A ring indicates that the sling has been over stress by dis-forming and not allowing the stress ball to pass through its middle.

A new lifting method is also disclosed. The new modified double basket lifting method is made possible by the present floating rings sling. In this preferred method, the circular strap is provided with two rings. The first ring is attached to a crane, or other lifting force, and the second ring leads the strap under a log, for example, up around the other side, over the top of the log, and then back under the log for a second time and then finally back up to attach to the crane. During the second pass under the log, the second ring passes through the middle of the double strap thereby forming a noose around the log. This lifting technique provides better gripping and a dramatically increased lifting maximum compared to the traditional double basket method.

BRIEF DESCRIPTION OF THE DRAWINGS

The invention of the present application will now be described in more detail with reference to the accompanying drawings, given only by way of example, in which.

DETAILED DESCRIPTION OF THE INVENTION

Figure 1:
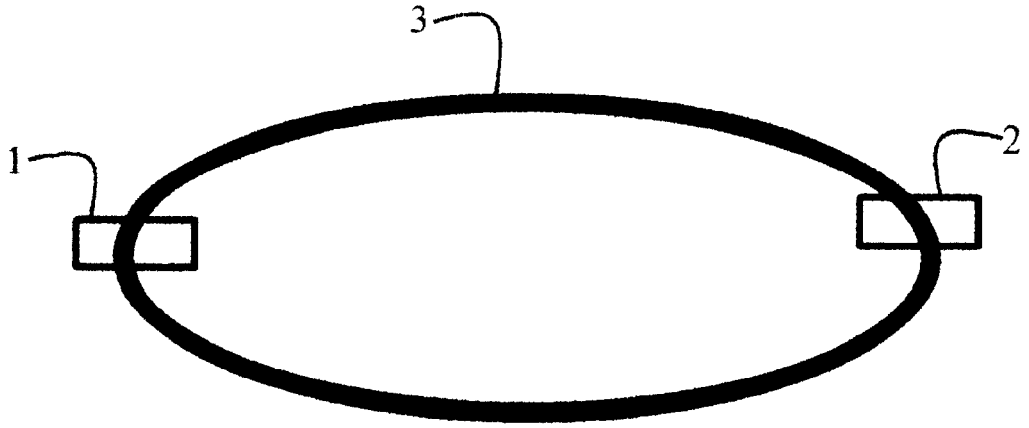
FIG. 1 is an illustration the preferred embodiment.

Referring to FIG. 1, the preferred embodiment of the present floating rings sling is shown. Rings 1 and 2 have a circular strap 3 that runs through the middle of each of the rings. In the preferred embodiment, rings 1 and 2 are made of a metal or a metal alloy and strap 3 is made of a man made webbing material. Rings 1 and 2 float freely around strap 3. Therefore, both rings can be together at one end of the strap 3, or the rings can be at opposite ends of circular strap 3, as is shown in FIG. 1. Rings 1 and 2 are usually 2–4 inches (") long, or alternatively, in diameter. The rings can be of an oblong or "D" shape in which case their length is measured along one of the ring's longest sides. Alternatively, the rings can be circular in shape, in which case the ring's measurement would be a diameter. Other ring shapes are discussed below. Rings 1 and 2 of FIG. 1 have been shown as having the same size however, alternative embodiments include using rings of different sizes. Some of these alternative embodiments provide for one of the rings to be small enough to pass through the second larger ring.

Having a strap with two different sized rings also allows for self-retraction of the strap. In a self-retraction embodiment, the sling is attached to the lifting force via another strap (or chain or rope) that is looped through the rings of the present sling. Once the object being lifted has reached its destination, one end of the other strap is unhooked from the lifting force and the opposite end is pulled so that the unhooked end travels toward the present sling. The unhooked end has a bulbous object attached to it that passes through the first larger ring of the present sling, thereby releasing the grip the sling had on the object being lifted. The bulbous object cannot pass through the second smaller ring of the present sling, so the entire sling along with the other strap is pulled back to the lifting force by pulling on the end of the strap that is still attached to the lifting force.

Referring again to FIG. 1, the length of strap 3 is measured when the rings 1 & 2 are located and opposite ends of the strap and pulled taught. So the length of strap 3 is equal to one half of the circumference of circular strap 3. Strap 3 can be made into any length and has several preferred lengths between the range of 6–20 feet (').

Figure 2:
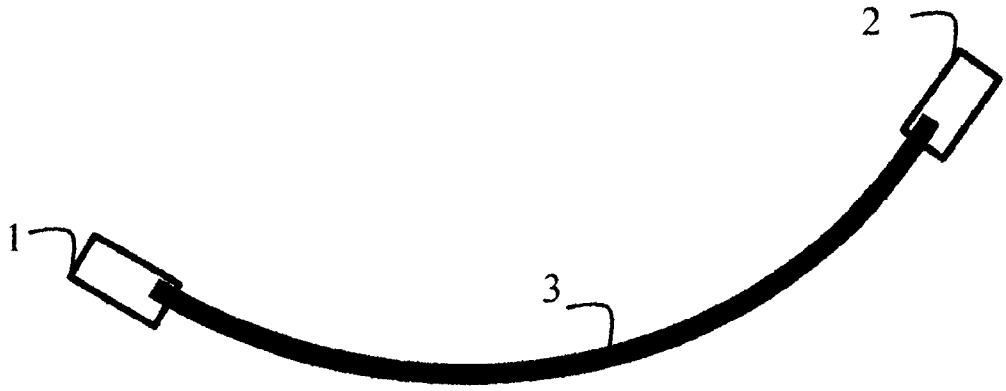
FIG. 2 is another illustration of the preferred embodiment.

FIG. 2 is intended to illustrate strap 3, when the strap has been pulled semi taught so that strap 3 appears to be a single strap. This is done for ease of illustration regarding the lifting method involving the present sling, discussed further below. Again, rings 1 and 2 are shown at opposite ends of strap 3. Strap 3 is also illustrated in FIG. 3 in this manner.

Figure 3:
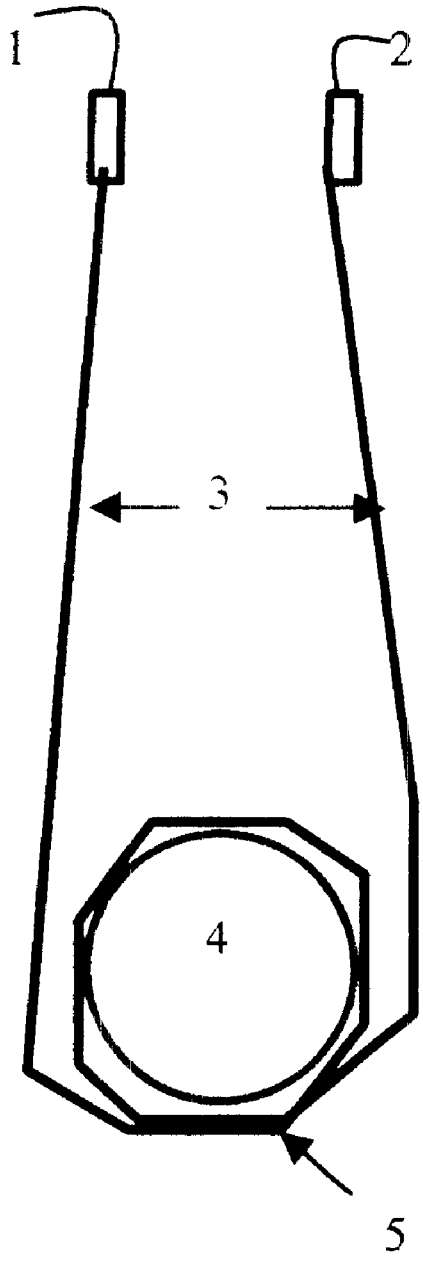
FIG. 3 is an illustration of the preferred method of use.

FIG. 3 illustrates the preferred lifting method using the present sling. While it may look like only a single strap is wrapped around log 4, as discussed above, a double strap is actually used. Rings 1 and 2 are at opposite ends of strap 3. In this method, ring 1 is left attached to a crane (not shown) that provides the actual lifting force. Ring 2 is wrapped under log 4, up around the top of log 4, and then back under log 4 for a second time and finally back up again toward the crane. During the second pass under log 4, ring 2 passes through the middle of double strap 3 at a point generally indicated by reference point 5. Ring 2 then continues back up to the attachment on the crane where ring 1 is or close to ring 1. This technique is a variation of what is known in the tree and logging industries as a "double basket". Of course, this variation of the double basket is only made possible by the design of the present sling. This preferred lifting method provides slip noose quality gripping, while the soft webbing does not materially damage the tree, log or pole. Using the present sling in this manner also doubles the lifting strength of the strap 3 when compared to conventional lifting techniques using traditional slings made of the same webbing material. So a strap that is certified for lifting 5,000 pounds (lbs.), can be used in the present sling and using the above method could lift a maximum of 10,000 lbs., thus doubling the conventional lifting strength of the strap.

Of course the present floating rings sling can be used in any of the conventional lifting techniques and is not limited to the lifting method illustrated above. For example, a single basket and a simple slip noose can be used with the present sling. Each of these techniques benefit from the virtual double strap of the present invention.

Figure 4:
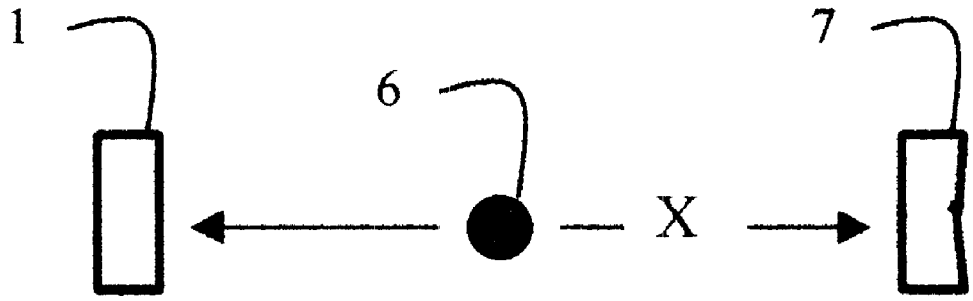
FIG. 4 illustrates the stress test available with the present sling.

FIG. 4 illustrates the stress test for the rings of the present sling. Solid test ball 6 has a diameter that is complementary to the distance between the two longest sides of ring 1. In other words, ball 6 can normally pass through the middle of ring 1. In this illustration, ring 1 represents a ring that is in good working order. Ball 6 can pass through the middle of ring 1. Ring 7 however, represents a ring that has experience too much stress on its associated strap. Because of damage, over work or lifting too much weight, ring 7 has warped inward. This causes a reduction in the distance between the longest sides of ring 7 i.e., the space through which test ball 6 must pass. In this case, test ball 6 can not pass through the middle of ring 7. The results of this test is that the sling to which ring 7 is attached should be discarded and no longer used.

If the rings of strap 3 are circular or ball shaped, the same solid ball test can be used. Over-stress on circular rings will also result in a closing or shrinking of the empty space in the middle of the rings, resulting in the ring being stretched into an oval. Test ball 6 would not be able to pass through the middle of such a ring, resulting in a clear failure of the stress test. Again, the entire sling assembly, strap and rings, should be discarded and no longer used.

Figure 5:
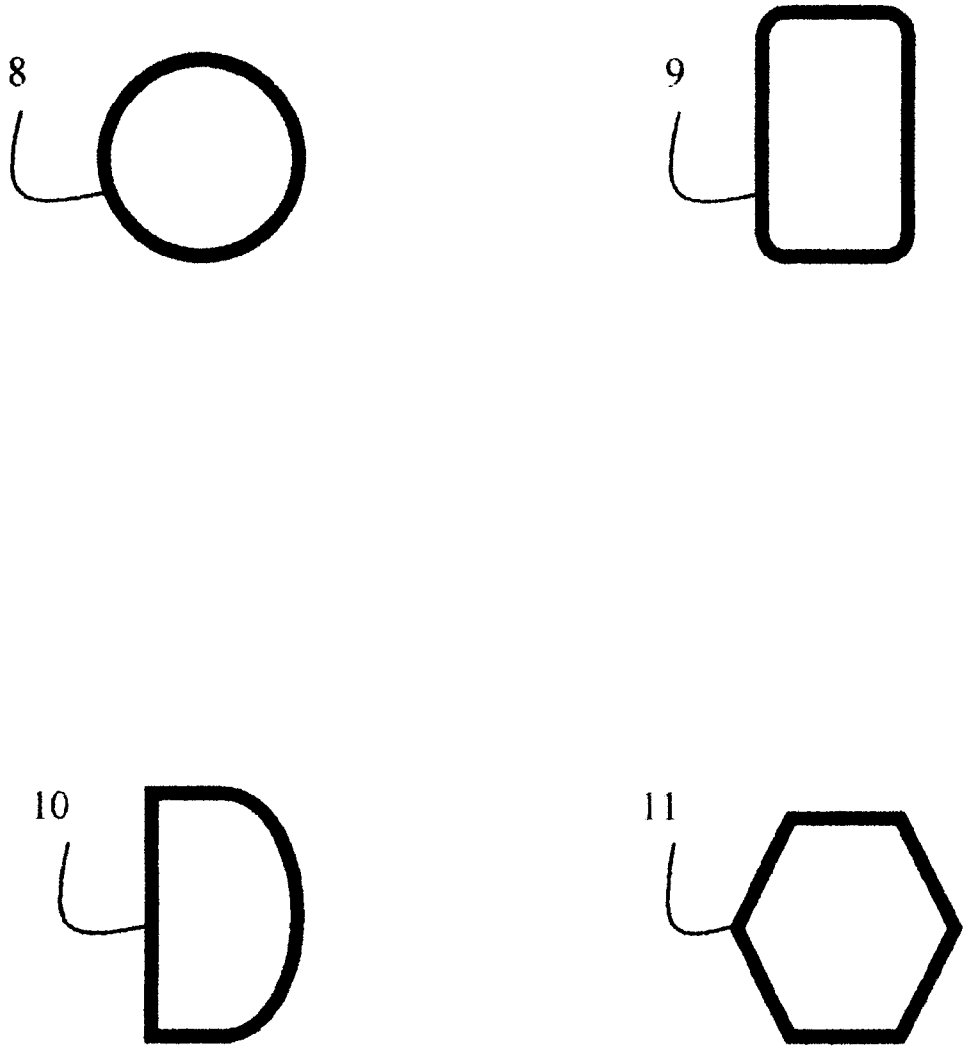
FIG. 5 shows exemplary shapes of rings.

FIG. 5 shows different shapes for the present rings. FIG. 5 is meant to be merely illustrative and not an exhaustive list of the possible shapes of the present rings. Ring 8 is in a round shape. Ring 9 is in the general shape of a rectangle with rounded comers. Ring 10 is in the classic "D" shape and ring 11 is hexagonal in shape. Each of the rings 8–11 can be produced in a variety of sizes and each is accompanied by an associated stress ball for stress testing.

The foregoing description of the specific embodiments will so fully reveal the general nature of the invention that others can, by applying current knowledge, readily modify and/or adapt for various applications such specific embodiments without departing from the generic concept. For example, the rings could be climber's carabeners and the webbing could be made of natural materials. Furthermore, the strap could be laid across a high limb on a tree and a climbing rope could slide freely through the two end rings. Also, the present sling could be used as a tie-off or tie-in point when secured to a post or tree. Therefore, such adaptations and modifications should and are intended to be comprehended within the meaning and range of equivalents of the disclosed embodiments. It is to be understood that the phraseology of terminology employed herein is for the purpose of description and not of limitation.

I claim:

1. A sling for lifting and moving objects including logs, poles and cylinders, comprising:

a circular strap made of a webbing material wherein the strap forms a complete circle and has a general uniform width;

at least one metal or metal alloy ring that floats freely around the circular strap wherein the strap passes through a middle of the metal or metal alloy ring(s); and, a stress ball that is a solid ball that is associated with each metal or metal alloy ring that is used in a stress test wherein the stress ball indicates that the sling has been over stressed when the ball cannot be passed through a middle of an associated ring.

2. The sling of claim 1, wherein two floating rings are provided and used at opposite ends of the circular strap allowing the strap to be used as if it were a single strap sling.

3. The sling of claim 2, wherein the two rings are of different sizes and a smaller one of the rings can fit through a middle of a larger one of the rings.

4. The sling of claim 1, wherein the sling has been manufactured to meet or exceed a safety standard including an ANSI standard for overhead lifting.

5. A method for lifting and moving objects including logs, poles and cylinders using a sling comprising a circular strap and one or more metallic rings wherein the strap forms a complete circle that runs through the middle each of the one or more rings, and wherein the one or more rings float freely around the circular strap, comprising the steps of:

attaching one end of the circular strap to a lifting force such as a hook on a crane via a first of the one or more metallic rings, taking the opposite end of the strap under the object to be lifted, then up a backside of the object, then over a top of the object, then again under the object wherein said opposite end of the strap passes between the two straps of the circular strap, and finally sending said opposite end back up the backside of the object, so that the strap has wrapped around the object at least one and a half times and forms a slip noose around the object; and connecting said opposite end of the strap to the lifting force so that the object is held in the sling via a modified double basket technique; and, testing the sling for over stress by passing a stress ball that is associated with each ring through a middle of each ring on the sling wherein if the ball passes through the middle of each ring then the sling is has passed the stress test and is in good working condition, further, if the ball can not be passed through the middle of the ring(s), then the sling has failed the test.

6. The method of claim 5, wherein the opposite end of the strap is connected to the lifting force via a second metallic ring.

7. A method for lifting and moving objects including logs, poles and cylinders using a sling comprising a circular strap and one or more metallic rings wherein the strap forms a complete circle and passes through a middle of each of the one or more rings so that the ring(s) float freely around the circular strap, comprising the steps of:

pulling the circular strap so that it flattens out forming essentially a double strap sling;

using the circular strap in any well known lifting technique that normally employs a single strap sling; and, testing the strap for over-stress by passing a testing device with a predetermined size through the middle of a ring that the testing device is associated with wherein the testing device ensures that the strap has not been over-stressed by making sure that the associated ring has not deformed inward.

8. The method of claim 7, wherein two rings are provided, one ring being used at each end of the strap.

9. The method of claim 8, wherein the rings are of two different sizes.

10. The method of claim 7, wherein the sling meets a safety standard including an ANSI standard for overhead lifting.

* * * * *